US012024976B1

(12) United States Patent
Rejepov et al.

(10) Patent No.: US 12,024,976 B1
(45) Date of Patent: Jul. 2, 2024

(54) CONDUCTOR RUNNING AND CEMENTING BRACKET (CRCB)

(71) Applicant: SAUDI ARABIAN OIL COMPANY, Dhahran (SA)

(72) Inventors: Dautmammet Rejepov, Abqaiq (SA); Yassar Kamal Zia, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/193,848

(22) Filed: Mar. 31, 2023

(51) Int. Cl.
*E21B 33/14* (2006.01)
*E21B 17/00* (2006.01)

(52) U.S. Cl.
CPC ..... *E21B 33/14* (2013.01); *E21B 17/003* (2013.01)

(58) Field of Classification Search
CPC ..... E21B 33/14; E21B 17/003
See application file for complete search history.

(56) References Cited

U.S. PATENT DOCUMENTS 3,312,280 A * 4/1967 Koplin ..... E21B 43/14 166/100
3,354,956 A * 11/1967 Critz ..... E21B 43/10 405/268
3,376,921 A * 4/1968 Manry ..... E21B 47/007 166/250.14
3,828,852 A * 8/1974 Delano ..... E21B 19/00 166/70
7,076,852 B2 7/2006 Penman et al.
10,151,166 B2 12/2018 Mathis
10,648,248 B2 5/2020 Strand et al.
11,028,549 B2 6/2021 Kannegaard et al.
11,293,248 B2 4/2022 Sæther et al.
2005/0087342 A1* 4/2005 Christensen ..... E21B 19/07 166/387
2013/0087346 A1* 4/2013 Pattillo ..... E21B 19/24 166/96.1

FOREIGN PATENT DOCUMENTS

CN 107598819 A 1/2018

* cited by examiner

*Primary Examiner* — James G Sayre
(74) *Attorney, Agent, or Firm* — Osha Bergman Watanabe & Burton LLP

(57) ABSTRACT

A conductor running and cementing bracket (CRCB) includes a plurality of support beams for supporting a conductor upon engagement with a conductor landing joint disposed on the conductor, wherein the plurality of support beams comprise a first set horizontally fixed to a second set. The CRCB further includes a side door elevator to grip the conductor thereby preventing further downhole movement at a landing level and a plurality of adjustable conductor extension sleeves arranged on the second set and extendable to variable lengths to accommodate conductors of varying diameters. The landing level of the conductor is below a rotary table level configured to hold a drill pipe via a rotary slip. Once the side door elevator is gripping the conductor, the conductor landing joint is removed and a drill pipe with a stinger is run into a wellbore. Upon running the drill pipe, a cementing operation is conducted.

19 Claims, 4 Drawing Sheets

CONDUCTOR RUNNING AND CEMENTING BRACKET (CRCB)

BACKGROUND

During drilling operations, it is common practice to use conventional conductor running and cementing practices. In conventional conductor running and cement practices, a false rotary table is required to provide a slip profile for the conductor casing and the cement stinger in order to perform the cement job. There is a mandatory wait on cement (WOC) before the conductor is cut and removed. The conductor that is cut is not usable anymore and the neck flange must be welded with a flanged connection. This conventional method requires a significant amount of rig time.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to conductor running and cementing bracket (CRCB), the CRCB comprising: a plurality of support beams for supporting a conductor upon engagement with a conductor landing joint disposed on the conductor, wherein the plurality of support beams comprise a first set of support beams horizontally fixed to a second set of support beams; a side door elevator to grip the conductor thereby preventing further downhole movement at a landing level; and a plurality of adjustable conductor extension sleeves arranged on the second set of support beams and extendable to variable lengths to accommodate conductors of varying diameters, wherein the landing level of the conductor is below a level of a rotary table configured to hold a drill pipe via a rotary slip, wherein, once the side door elevator is gripping the conductor at the landing level, the conductor landing joint is removed and a drill pipe with a stinger is run into a wellbore, wherein, upon running the drill pipe with the stinger into the wellbore, a cementing operation is conducted at the landing level.

In one aspect, embodiments disclosed herein relate to system for running and cementing a conductor, the system comprising: a conductor running and cementing bracket (CRCB) comprising: a plurality of support beams for supporting a conductor upon engagement with a conductor landing joint disposed on the conductor, wherein the plurality of support beams comprise a first set of support beams horizontally fixed to a second set of support beams; a side door elevator to grip the conductor thereby preventing further downhole movement at a landing level of the conductor below a level of a rotary table; and a plurality of adjustable conductor extension sleeves arranged on the second set of support beams and extendable to variable lengths to accommodate conductors of varying diameters; a drill pipe comprising a stinger configured to run into a wellbore once the side door elevator is gripping the conductor at the landing level and the conductor landing joint is removed; and a rotary slip configured to hold the drill pipe to the rotary table.

In one aspect, embodiments disclosed herein relate to a method for a conductor running and cementing bracket (CRCB), the method comprising: placing the CRCB across a cellar at a landing level by extending a plurality of adjustable conductor extension sleeves to a size of a conductor, wherein the landing level is below a level of a rotary table configured to hold a drill pipe via a rotary slip, wherein the CRCB comprises: a plurality of support beams for supporting the conductor upon engagement with a conductor landing joint disposed on the conductor, wherein the plurality of support beams comprise a first set of support beams horizontally fixed to a second set of support beams; and a side door elevator to grip the conductor thereby preventing further downhole movement at the landing level, wherein a plurality of adjustable conductor extension sleeves are arranged on the second set of support beams and extendable to variable lengths to accommodate conductors of varying diameters; running the conductor to a predetermined depth to land the conductor landing joint on the side door elevator; removing the conductor landing joint once the side door elevator is gripping the conductor at the landing level; running a drill pipe with a stinger into a wellbore through the conductor and CRCB once the conductor landing joint is removed; setting the drill pipe with a rotary slip to the rotary table; and performing a cementing operation at the landing level with the drill pipe in the wellbore.

Other aspects and advantages of the claimed subject matter will be apparent from the following description and the appended claims.

DETAILED DESCRIPTION

Figure 1:
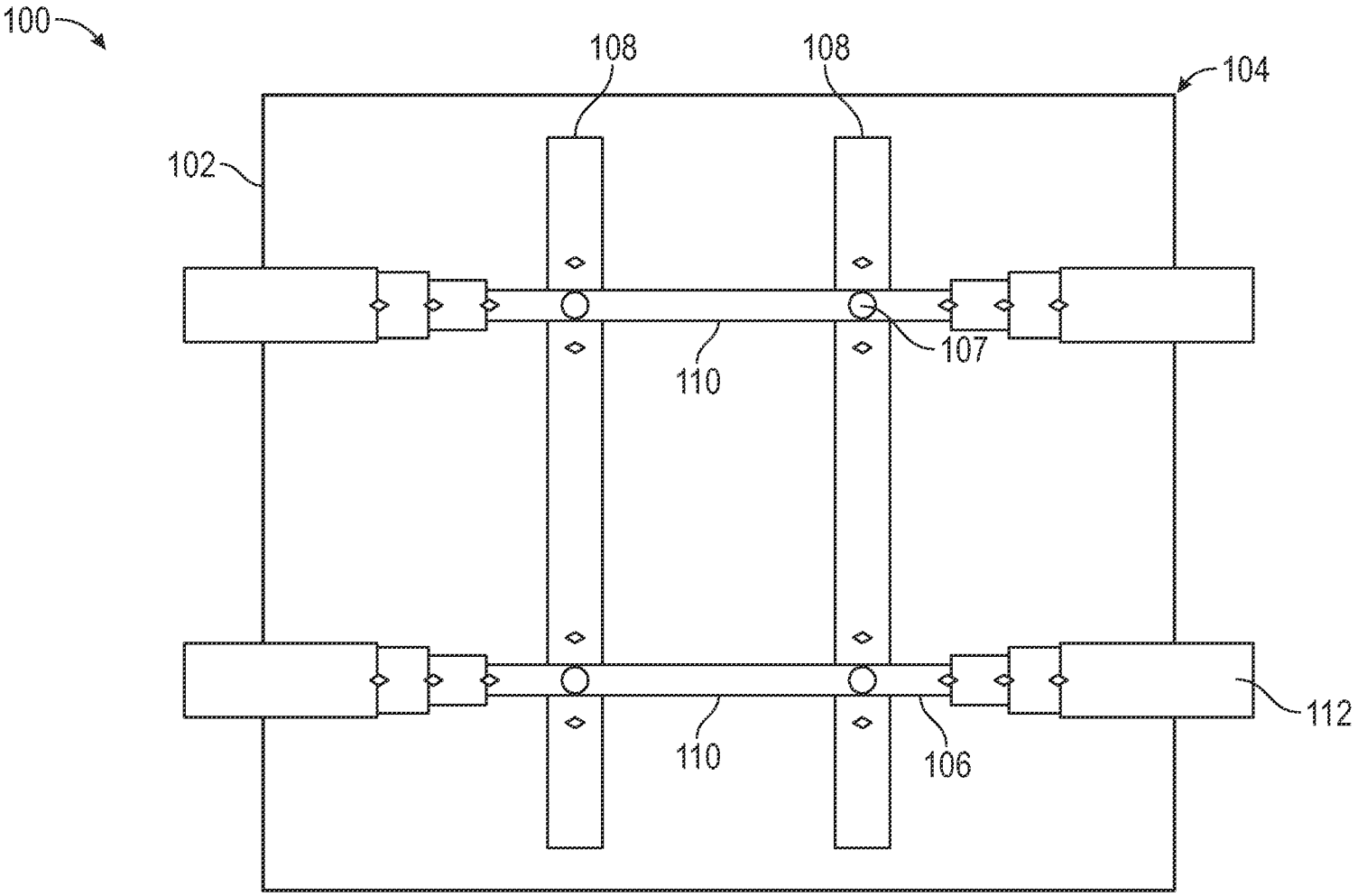
FIG. 1 shows an apparatus in accordance with one or more embodiments.

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and method for performing conductor running and cementing operations using a conductor running and cementing bracket (CRCB). In some embodiments, for example, the CRCB allows for suspending a conductor at a cellar level instead of at a rotary level as performed in conventional methods. Therefore, the rotary table is free to be used for other operations such as make up a next phase of bottom hole assembly and drill pipes without the need of waiting on cement (WOC). WOC pertains to the time when drilling or completion operations are suspended so that cement in a well can harden sufficiently. Without the need of WOC, a total of nine to sixteen hours of rig time may be saved. The CRCB eliminates the need for rigging up a false rotary table since the false rotary table is free to run a drill pipe.

FIG. 1 shows a conductor running and cementing bracket (CRCB) (100) in accordance with one or more embodiments. Specifically, FIG. 1 shows a top bird's eye view of the CRCB (100) placed on a cellar (102) at a landing level (104). The cellar (102) may be any dug-out area located below a rig. The cellar may be lined with wood, cement, or large diameter thin-wall pipe. The landing level (104) may be ground level. The CRCB (100) includes a plurality of support beams (106). Specifically, a first set of support beams (108) is fixed horizontally to a second set of support beams (110). In some embodiments, the first set of two support beams (106) is fixed horizontally to a second set of two support beams (106).

For example, the support beams (106) illustrated in FIG. 1 have four support points (107) where the first set of support beams (108) meet the second set of support beams (110). Each of the first set and second set of support beams (110) are distanced from one another based on a diameter of a planned conductor landing joint. The second set of support beams (110) include a plurality of adjustable conductor extension sleeves (112). The adjustable conductor extension sleeves (112) are extended to allow the support beams (106) to be placed on the cellar (102). The adjustable conductor extension sleeves (112) are extendable to variable lengths to accommodate varying conductor diameters and cellar (102) widths and lengths. The adjustable conductor extension sleeves (112) may be designed to be of a material strength capable of supporting the heaviest and deepest conductor possible. The CRCB (100) includes a bracket size based on the support beams (106) and adjusted for a planned size of a conductor.

For example, as illustrated in FIG. 1, the adjustable conductor extension sleeves (112) may be three sleeves arranged on the support beams (106). Specifically, the adjustable conductor extension sleeves (112) are illustrated for a proposed conductor design of common sizes such as 24 inches, 30 inches, and 36 inches. The support beams (106) may be adjustable support beams that function as a connection between two adjustable conductor extension sleeves (112).

Figure 2:
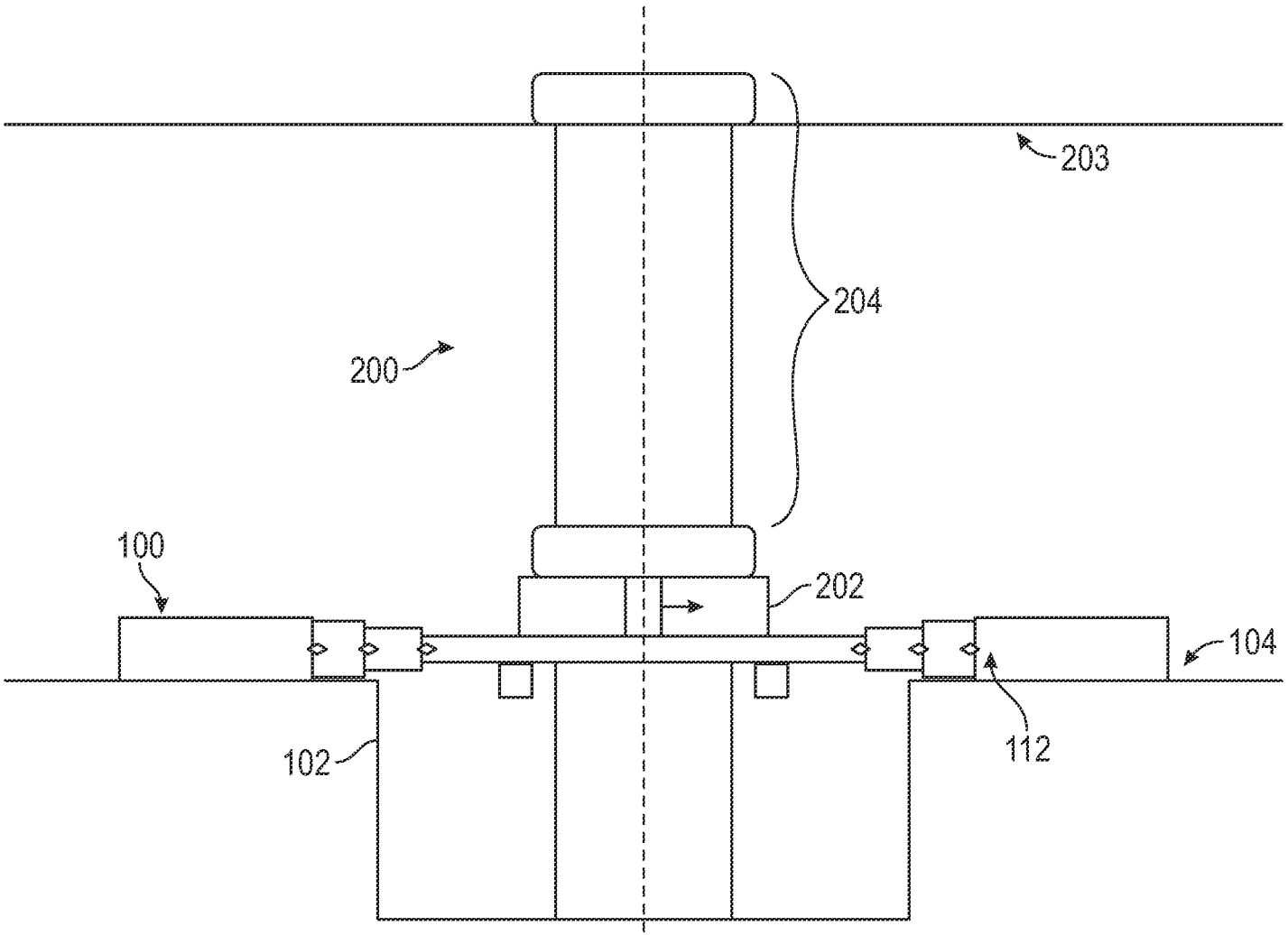
FIG. 2 shows a system in accordance with one or more embodiments.

FIG. 2 shows a system in accordance with one or more embodiments. Specifically, FIG. 2 shows the CRCB (100) at the landing level (104) in FIG. 1 implemented in a system with a conductor (200) landed on a side door elevator (202). The CRCB (100) is placed across the cellar (102). The cellar (102) may be below a rotary table (203). The conductor (200) may include a plurality of casing joints with threaded connections. Casing joints may be connected with a casing coupling. When drilling a wellbore to a predetermined depth of a formation, the wellbore is lined with a string of casing, such as the conductor (200). An annulus between the outer side of the conductor (200) and the formation is then filled with cement to permanently set the conductor (200) in a wellbore. More than one string of casing may be employed at different depths within a wellbore.

As shown in FIG. 2, the CRCB (100) includes the side door elevator (202) to grip the conductor (200) when employed in a wellbore. A person of ordinary skill in the art would appreciate that the side door elevator (202) may be any tubular handling tool able to wrap around tool joints of drill pipe, casing, or lift collars. For example, the side door elevator (202) is placed on the CRCB (100) around the conductor (200). The side door elevator (202) may be positioned from the side of the conductor (200). The conductor (200) includes a conductor landing joint (204) to aide in landing on the side door elevator (202). The conductor landing joint (204) may be a heavy casing joint. The conductor landing joint (204) may be removed and reusable in other wells. The CRCB (100) prevents the conductor landing joint (204) from being cut and thrown away. The side door elevator (202) grips the conductor (200) to prevent further downhole movement at the landing level (104). The side door elevator (202) aides in the removal of the CRCB (100).

Keeping with FIG. 2, the landing conductor joint (204) may be used to allow disconnecting of the conductor landing joint (204) at landing level (104) once the conductor (200) is landed on the CRCB (100). In some embodiments, the side door elevator (202) grips the conductor (200) at the landing level (104) for removal of the conductor landing joint (204). The conductor landing joint (204) may be flanged. In some embodiments, the conductor (200) is torqued at a non-optimum level and tension in the conductor landing joint (204) from the conductor (200) landing on the CRCB (100) decreases. The non-optimum level may be the area of the threaded connection between the conductor landing joint (204) and the rest of the conductor (200). This allows disconnection and removal of the conductor landing joint (204). In one or more embodiments, the conductor landing joint (204) may be prepared with a left-hand connection to aide in disconnection of the conductor landing joint (204) from the rest of the conductor (200). The left-hand connection may be a reverse thread used to force a right-handed screw or bolt to come loose. The conductor landing joint (204) may be disconnected from the rest of the conductor (200) by applying pressure to the threaded connection.

Without the CRCB (100), the last joint of the conductor (200) has to be cut after waiting on cement (WOC). The neck flange of the cut conductor joint must then be welded with a flanged connection. A diverter is then nippled up on the flanged connection in order to make up a bottom hole assembly for a next hole or continue with any routine operations. Nippling up may refer to assembling pressure control equipment on a wellhead. A pressure and function test may be done on the diverter.

Figure 3:
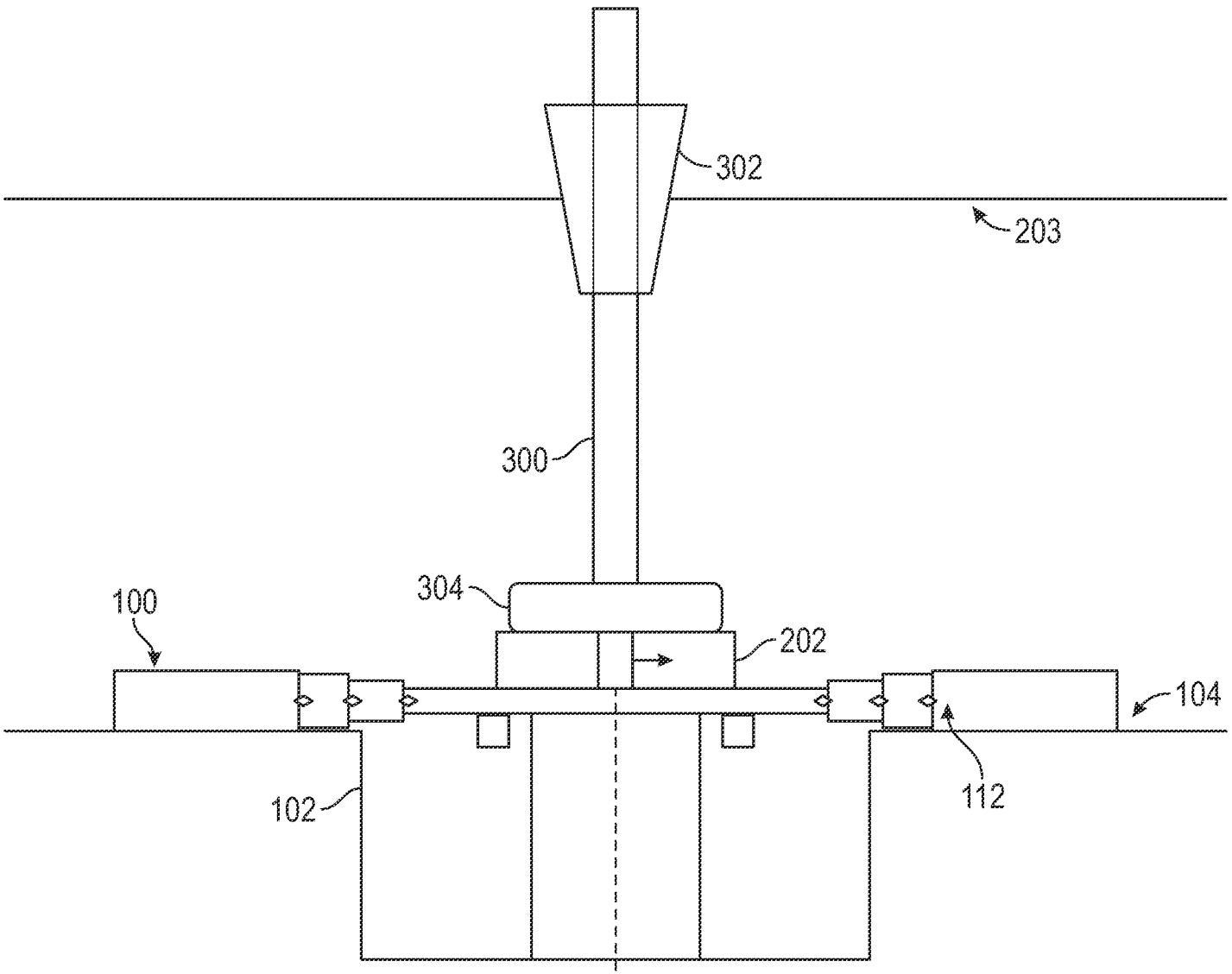
FIG. 3 shows a system in accordance with one or more embodiments.

FIG. 3 shows a system in accordance with one or more embodiments. Specifically, FIG. 3 shows a drill pipe (300) run into the conductor (200) after the conductor landing joint (204) is removed. The CRCB (100) supports the weight of the conductor (200). The drill pipe (300) may include a cement stinger to stab the drill pipe (300) into a float shoe. The float shoe serves as a guide shoe for casing, such as the conductor (200). The float shoe may be any short and cylindrical steel section with rounded bottom attached to the bottom of a casing string, such as the conductor (200). The float shoe may include a check valve and serve to reduce hook weight. The drill pipe (300) is set with one or more rotary slips (302) on the rotary table (203). The rotary slips (302) may be any device used to grip and hold the drill pipe (300) to the rotary table (203). The rotary slips (302) hold the drill pipe (300) to prevent the drill pipe (300) from moving downhole. The drill pipe (300) may be any hollow tube with the ability to raise, lower, and rotate a bottom hole assembly.

The drill pipe (300) may include a drill bit in a bottom hole assembly to cut rock as it is drilled into a reservoir. Once the drill pipe lands on the rotary table (203), a cement operation is conducted at the landing level (104). The cement operation may include mixing and pumping cement through the drill pipe (300) and up an annulus between the conductor (200) and formation. A pre-planned neck flange with threaded connection may be made up on a box collar (304) of the conductor (200) after cementing. The pre-planned neck flange allows nippling up of a diverter without welding. The diverter may be made up with a flanged connection. Pressure and function tests may be conducted on the diverter. Routine operations may continue.

Figure 4:
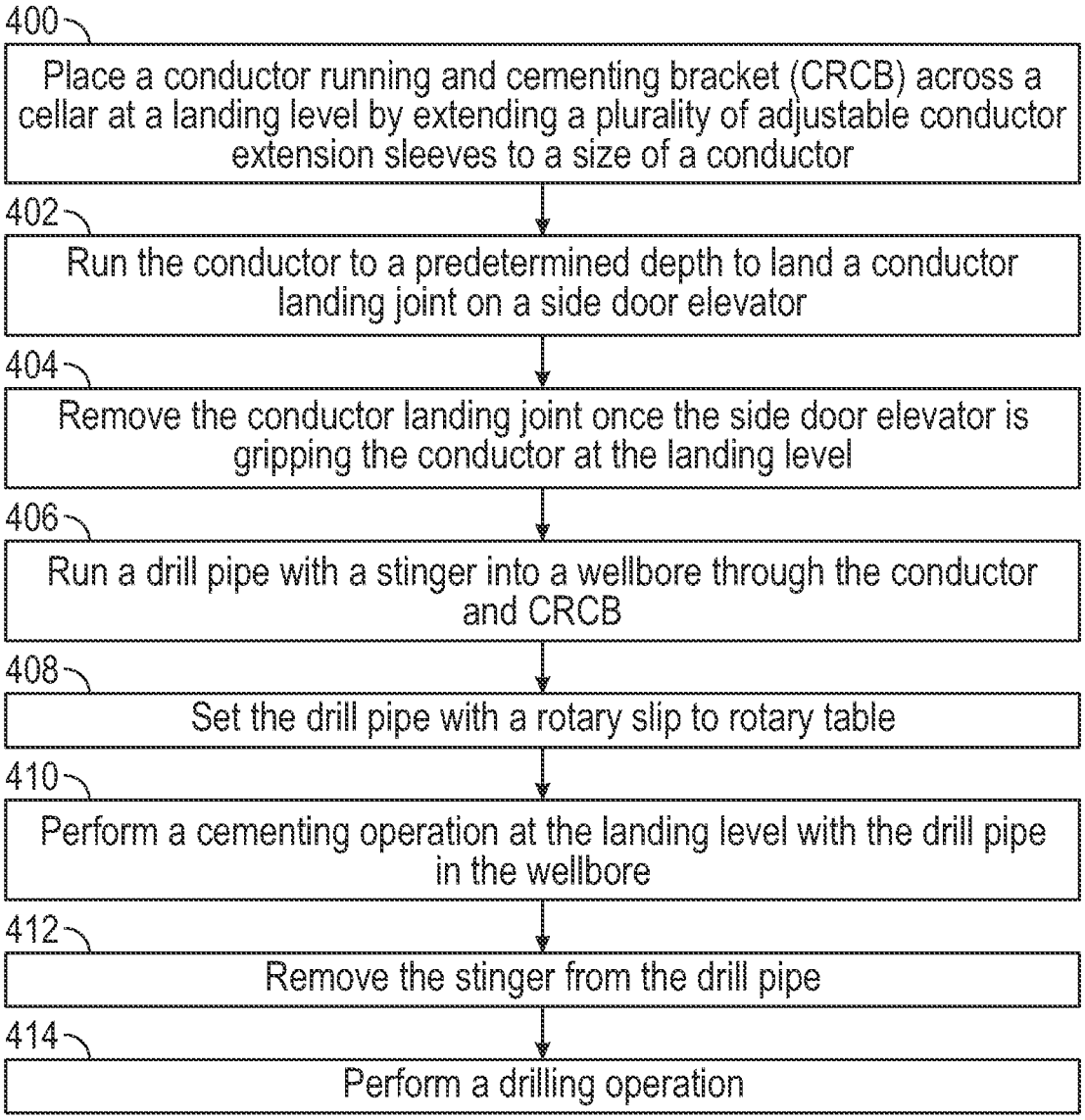
FIG. 4 shows a flowchart in accordance with one or more embodiments.

FIG. 4 shows a flowchart in accordance with one or more embodiments. Specifically, FIG. 4 describes a method for running and cementing a conductor. One or more blocks in FIG. 4 may be performed by one or more components (e.g., CRCB (100)) as described in FIGS. 1-3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, in Block 400, a conductor running and cementing bracket (CRCB) (100) is placed across a cellar (102) at a landing level (104) by extending a plurality of conductor extension sleeves (112) to a size of a conductor (200). The landing level (104) is below a level of a rotary table (203). The rotary table (203) holds a drill pipe (300) via a rotary slip (302). The CRCB (100) includes a plurality of support beams (106) and a side door elevator (202). The support beams (106) support the conductor (200) upon engagement with a conductor landing joint (204). The conductor landing joint (204) may be part of the conductor (200). The support beams (106) include a first set of support beams (108) horizontally fixed to a second set of support beams (110). Each of the first set of support beams (108) and second set of support beams (110) may be distanced from one another based on a diameter of the conductor landing joint (204). The CRCB (100) includes a bracket size to be adjusted for a planned size of the conductor (200) using the support beams (106). The conductor landing joint (204) may be removed. A plurality of adjustable conductor extension sleeves (112) are arranged on the second set of support beams (110). The adjustable conductor extension sleeves (112) are extendable to variable lengths to accommodate conductors of varying diameters.

In Block 402, the conductor (200) is run to a predetermined depth to land the conductor landing joint (204) on the side door elevator (202). The side door elevator (202) grips the conductor (200) thereby preventing further downhole movement at the landing level (104). In Block 404, the conductor landing joint (204) is removed once the side door elevator (202) is gripping the conductor (200) at the landing level (104).

In Block 406, a drill pipe (300) with a stinger is run into a wellbore through the conductor (200) and CRCB (100). In Block 408, the drill pipe (300) is set to a rotary table (203) with a rotary slip (302). In Block 410, a cementing operation is performed at the landing level (104) with the drill pipe (300) in the wellbore. The CRCB (100) may be removed after the cementing operation.

In Block 412, the stinger is removed from the drill pipe (300). With the same connection at the conductor (200), a pre-planned neck flange with threaded connection may be made up on a box collar (304) of the conductor once cemented. The box collar (304) may be a thick tubular piece where the conductor landing joint (204) was connected to the conductor (200). A diverter may be nippled up to the pre-planned neck flange. Pressure and function test may be conducted on the diverter. In Block 414, a drilling operation is performed based on removal of the stinger. The drilling operation may include making up a bottom hole assembly for a next hole. The drilling operation may proceed without waiting on cement (WOC) as rotary table (203) is available.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A conductor running and cementing bracket (CRCB), the CRCB comprising:

a plurality of support beams for supporting a conductor upon engagement with a conductor landing joint disposed on the conductor, wherein the plurality of support beams comprise a first set of support beams horizontally fixed to a second set of support beams;

a side door elevator to grip the conductor thereby preventing a downhole movement at a landing level; and a plurality of adjustable conductor extension sleeves arranged on the second set of support beams and extendable to variable lengths to accommodate conductors of varying diameters, wherein the landing level of the conductor is below a level of a rotary table configured to hold a drill pipe via a rotary slip, wherein, once the side door elevator is gripping the conductor at the landing level, the conductor landing joint is removed and a drill pipe with a stinger is run into a wellbore, wherein, upon running the drill pipe with the stinger into the wellbore, a cementing operation is conducted at the landing level.

2. The CRCB of claim 1, wherein each of the first set of support beams are distanced from one another based on a diameter of the conductor landing joint.

3. The CRCB of claim 1, wherein each of the second set of support beams are distanced from one another based on a diameter of the conductor landing joint.

4. The CRCB of claim 1, wherein the conductor landing joint is configured to be removed.

5. The CRCB of claim 4, wherein the conductor landing joint is flanged.

6. The CRCB of claim 1, wherein the CRCB comprises a bracket size configured to be adjusted for a planned size of the conductor.

7. A system for running and cementing a conductor, the system comprising:

a conductor running and cementing bracket (CRCB) comprising:

a plurality of support beams for supporting a conductor upon engagement with a conductor landing joint disposed on the conductor, wherein the plurality of support beams comprise a first set of support beams horizontally fixed to a second set of support beams;

a side door elevator to grip the conductor thereby preventing a downhole movement at a landing level of the conductor below a level of a rotary table; and a plurality of adjustable conductor extension sleeves arranged on the second set of support beams and extendable to variable lengths to accommodate conductors of varying diameters;

a drill pipe comprising a stinger configured to run into a wellbore once the side door elevator is gripping the conductor at the landing level and the conductor landing joint is removed; and a rotary slip configured to hold the drill pipe to the rotary table.

8. The system of claim 7, wherein each of the first set of support beams are distanced from one another based on a diameter of the conductor landing joint.

9. The system of claim 7, wherein each of the second set of support beams are distanced from one another based on a diameter of the conductor landing joint.

10. The system of claim 7, wherein the conductor landing joint is configured to be removed.

11. The system of claim 7, wherein the conductor landing joint is flanged.

12. The system of claim 7, wherein the CRCB comprises a bracket size configured to be adjusted for a planned size of the conductor.

13. A method for a conductor running and cementing bracket (CRCB), the method comprising:

placing the CRCB across a cellar at a landing level by extending a plurality of adjustable conductor extension sleeves to a size of a conductor, wherein the landing level is below a level of a rotary table configured to hold a drill pipe via a rotary slip, wherein the CRCB comprises:

a plurality of support beams for supporting the conductor upon engagement with a conductor landing joint disposed on the conductor, wherein the plurality of support beams comprise a first set of support beams horizontally fixed to a second set of support beams; and a side door elevator to grip the conductor thereby preventing a downhole movement at the landing level, wherein a plurality of adjustable conductor extension sleeves are arranged on the second set of support beams and extendable to variable lengths to accommodate conductors of varying diameters;

running the conductor to a predetermined depth to land the conductor landing joint on the side door elevator;

removing the conductor landing joint once the side door elevator is gripping the conductor at the landing level;

running a drill pipe with a stinger into a wellbore through the conductor and CRCB once the conductor landing joint is removed;

setting the drill pipe with a rotary slip to the rotary table; and performing a cementing operation at the landing level with the drill pipe in the wellbore.

14. The method of claim 13, further comprising:

removing the stinger from the drill pipe; and performing a drilling operation based on removal of the stinger.

15. The method of claim 13, wherein each of the first set of support beams are distanced from one another based on a diameter of the conductor landing joint.

16. The method of claim 13, wherein each of the second set of support beams are distanced from one another based on a diameter of the conductor landing joint.

17. The method of claim 13, wherein the conductor landing joint is configured to be removed.

18. The method of claim 13, wherein the conductor landing joint is flanged.

19. The method of claim 13, wherein the CRCB comprises a bracket size configured to be adjusted for a planned size of the conductor.

* * * * *